US006181289B1

(12) United States Patent
Matsui

(10) Patent No.: US 6,181,289 B1
(45) Date of Patent: Jan. 30, 2001

(54) MULTIBEAM ANTENNA REFLECTOR

(75) Inventor: Yoshikazu Matsui, Himeji (JP)

(73) Assignee: DX Antenna Company, Limited, Kobe (JP)

( * ) Notice: Under 35 U.S.C. 154(b), the term of this patent shall be extended for 0 days.

(21) Appl. No.: 09/420,265

(22) Filed: Oct. 18, 1999

(51) Int. Cl.[7] ..... H01Q 13/00
(52) U.S. Cl. ..... 343/781
(58) Field of Search ..... 343/781, 840, 343/815, 817, 818, 819, 832, 836, 837

(56) References Cited

U.S. PATENT DOCUMENTS 4,603,334 * 7/1986 Mizuguchi et al. ..... 343/779
5,140,337 * 8/1992 Rappaport ..... 343/840
5,283,591 * 2/1994 Delmas ..... 343/755
5,790,777 * 8/1998 Luh et al. ..... 343/781
5,828,344 * 10/1998 Alder et al. ..... 343/755
5,859,619 * 1/1999 Wu et al. ..... 343/781
5,913,151 * 6/1999 Lusignan ..... 343/781
5,949,594 * 9/1999 Iglseder et al. ..... 359/853

FOREIGN PATENT DOCUMENTS 5-191139 7/1993 (JP) .

* cited by examiner

*Primary Examiner*—Don Wong
*Assistant Examiner*—Trinh Vo Dinh
(74) *Attorney, Agent, or Firm*—Duane, Morris & Heckscher LLP

(57) ABSTRACT

A multibeam antenna reflector having a reflection surface expressed by a combination of at least first and second corrected surface functions which are individually corrected so that they can have a large beam deviation angle. The respective corrected surface functions are combined together by being weighted and averaged with each other.

7 Claims, 11 Drawing Sheets

MULTIBEAM ANTENNA REFLECTOR

This invention relates to a reflector for a multibeam antenna which can transmit and receive electromagnetic waves in and from different directions.

BACKGROUND OF THE INVENTION

An example of a multibeam antenna is disclosed in, for example, Japanese unexamined patent publication No. HEI 5-191139 published on Jul. 30, 1993. The antenna disclosed in this publication includes two primary radiators disposed to radiate beams to the same point on an offset paraboloidal reflector of the antenna. In this antenna, an axis passing through the aperture center of the paraboloidal reflector and paralleling the parabola axis of the reflector is defined as a beam axis of the paraboloidal reflector. One of the two primary reflectors is located at the focal point of the reflector, and the other radiator is located on the beam axis. The angle between the line passing through the aperture center and the focal point of the reflector and the parabola axis is defined as a tilt angle. The tilt angle is from 1 to 1.4 times a desired beam width.

A reflector meeting the above-stated condition cannot be a versatile reflector, but it can only reflect a beam in or from a specific direction. Recently, satellite communications and satellite broadcasting are common. Accordingly, parabolic antennas which can be used only single satellites are not desirable in manufacturing cost. In addition, in this type of paraboloidal reflectors, aberration due to displaced feeding is minimized under some specific conditions, which results in a large focal-length-to-aperture ratio, F/D, of the paraboloidal reflector.

Therefore, an object of the present invention is to provide a versatile reflector for a multibeam antenna which has a similar size to an ordinary paraboloidal reflector.

SUMMARY OF THE INVENTION

A multibeam antenna according to the present invention includes a reflector surface expressed by at least first and second corrected surface functions combined or merged together. The first corrected surface function can be defined in a coordinate system having a horizontal axis X1, a vertical axis Y1 and an axis Z1 perpendicular to the plane defined by the X1 and Y1 axes, as follows.

$$z1=[-(x1^2+y1^2)/4(F1+g(x1, y1))]+F1$$

where g(x1, y1) is expressed by k1(y1+α)+k2(|x1|+β), α is a value not smaller than −(of+D) and not greater than (of+D), β is a value not smaller than −D/2 and not greater than D/2, of is the amount of offset of the reflector which is equal to or greater than 0, D is the diameter of a circle resulting from projecting a given area of the first corrected surface function onto the X1-Y1 plane, F1 is the focal length of the first corrected surface function, and k1 and k2 are coefficients.

The second corrected surface function is defined in a coordinate system having a horizontal axis X2, a vertical axis Y2 and an axis Z2 perpendicular to the plane defined by the X2 and Y2 axes, as follows.

$$z2=[-(x2^2+y2^2)/4(F2+g(x2,y2))]+F2$$

where g(x2, y2) is expressed by k1(y2+α)+k2(|x2|+β), α is a value not smaller than −(of+D) and not greater than (of+D), β is a value not smaller than −D/2 and not greater than D/2, of is the amount of offset of the reflector which is equal to or greater than 0, D is the diameter of a circle resulting from projecting a given area of the second corrected surface function onto the X2-Y2 plane, F2 is the focal length of the second corrected surface function, and k1 and k2 are coefficients.

The multibeam antenna reflector is in a combined or merged area expressed by a function formed by weighted-averaging the first and second corrected surface functions with the Z1 and Z2 axes disposed in parallel with respective ones of at least two directions from which electromagnetic waves come. The focuses of the first and second corrected surface functions are determined such that the coordinates of the first and second corrected surface functions at the center of the combined area are the same, and that the normals of the first and second corrected surface function at the center of the combined area are in alignment with each other.

It may be that k2=0, k1<0, and α=−(of+D/2).

It may be that k1=0, k2>0, and β=0.

It may be that k1=0.

It may be that k1=k2, α=−(of+D/2), and β=0.

It may be that k1 and k2 each are equal to or greater than −0.2 and equal to or smaller than 0.2.

Additional (m−2) surface functions, where m is a positive integer equal to or greater than three, may be combined with the first and second corrected surface functions by being weighted and averaged with the first and second corrected surface functions. Any additional n-th reflector is expressed by a parabolic function or a corrected surface function in a coordinate system defined by a horizontal axis Xn, a vertical axis Yn and an axis Zn perpendicular to the plane defined by the Xn and Yn axes, where n is a positive integer equal to or greater than 3 and equal to or smaller than m, with the axis Zn disposed along the direction from which an n-th electromagnetic wave comes.

DETAILED DESCRIPTION OF EMBODIMENTS

According to the present invention, a multibeam antenna reflector has a reflecting surface expressed by a function which is a combination of at least two corrected surface function. First, the corrected surface functions are described. However, before that, a conventional paraboloidal reflector receiving an electromagnetic wave from a diagonal direction is described.

Figure 1A:
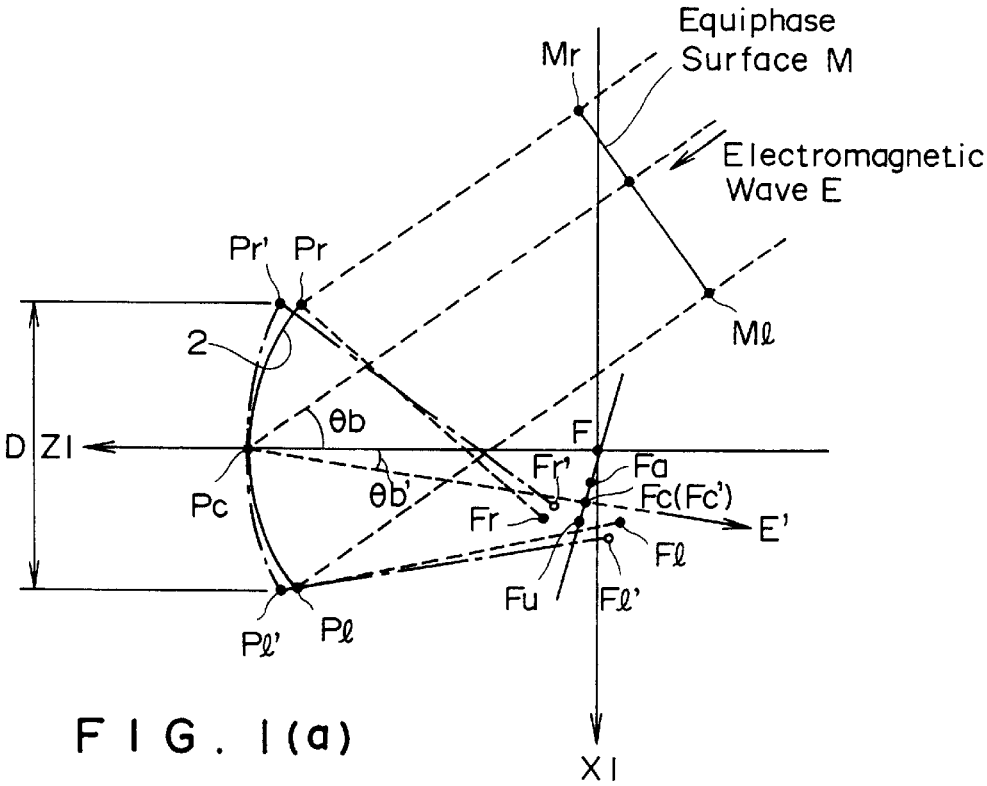
FIGS. 1(*a*) and 1(*b*) respectively illustrate how electromagnetic waves are reflected from a reflector according to a basic corrected surface function of the present invention and from a prior art offset paraboloidal reflector.
Figure 1B:
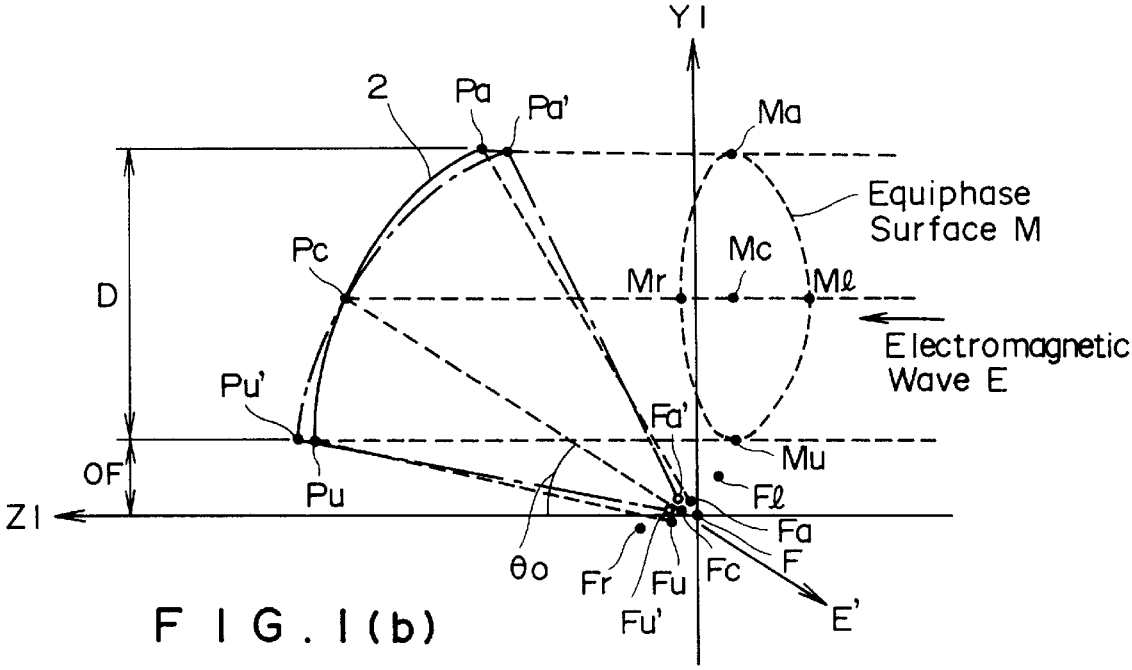
Figure 2A:
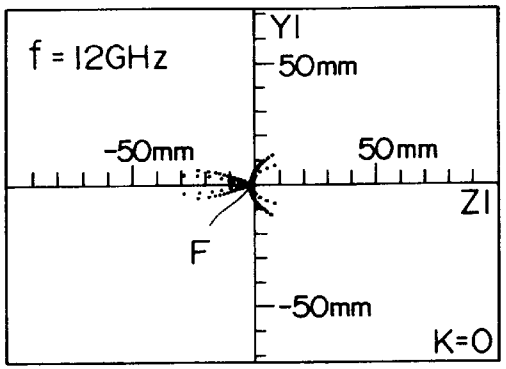
FIGS. 2(*a*) through 2(*d*) illustrate convergence of equiphase points of the reflector according to the basic corrected surface function of the present invention and the prior art offset paraboloidal reflector.
Figure 2C:
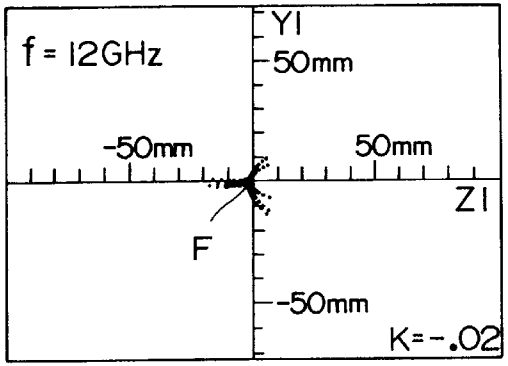
Figure 2B:
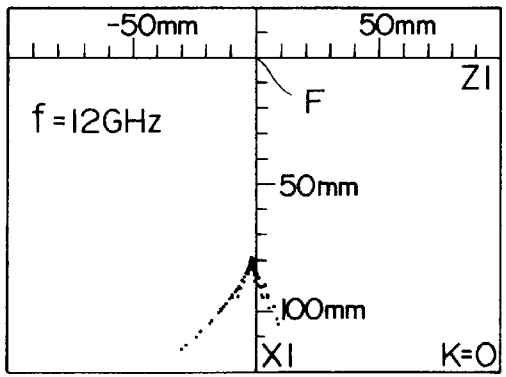
Figure 2D:
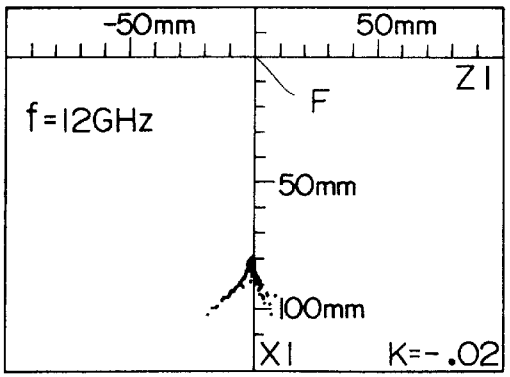

As shown in FIGS. 1(*a*) and 1(*b*) which are plan and side views of an offset paraboloidal reflector 2, in the reflection surface of the offset paraboloidal reflector 2, a coordinate system is defined by a horizontal axis X1, a vertical axis Y1, and an axis Z1 perpendicular to the plane defined by the X1 and Y1 axes. The focal point of the reflector 2 on the Z1 axis is defined as the origin of the coordinate system. The angle between the electromagnetic wave E as projected onto the X1-Z1 plane and the Z1 axis is defined as a beam deviation angle θb. The reflection surface of the reflector 2 is expressed by the following expression (1), in which F1 is the focal length of the reflector.

$$z1=[-(x1^2+y1^2)/4F1\ ]+F1 \quad (1)$$

A plane M resulting from projecting the offset paraboloidal reflector onto a plane perpendicular to the electromagnetic wave vector E can be considered to be an equiphase surface of the electromagnetic wave E corresponding to the aperture plane of the reflector 2.

Let it be assumed that the upper and lower ends of the reflector 2 along the Y1 axis are Pa and Pu, respectively, that the positive and negative side ends along the X1 axis are Pl and Pr, respectively, and the corresponding points on the equiphase surface are Ma, Mu, Mr and Ml, respectively. Since the points Ma, Mu, Mr and Ml are points on the equiphase surface M, the electric fields at these points are in phase.

The field which has passed through a point, e.g. the point Ma, in the equiphase surface M propagates in parallel with the direction of the wave E and is reflected from a point, e.g. Pa, on the reflector 2 toward a point in the vicinity of the focal point F of the reflector 2.

A set of points on the propagation paths at the same distance from the equiphase surface M is a set of equiphase points. Equiphase points which are in the vicinity of the focal point F and correspond to the points Ma, Mu, Mr and Ml on the equiphase surface are designated as Fa, Fu, Fr and Fl in FIGS. 1(*a*) and 1(*b*). The electric field passing through the center Mc of the equiphase surface M reaches the center point Pc of the reflector 2 and is reflected in a direction E'. The line interconnecting the origin O and the equiphase point Fc in the E' direction corresponding to the points Mc and Pc forms an angle θb' (feed displacement angle) with the Z1 axis (FIG. 1(*a*)). When the equiphase points Fc, Fa, Fu, Fr and Fl converge most, they spread about Fc in the projection on the Z1-X1 plane, and are dispersed on a curved plane extending generally perpendicular to the direction E' when viewed in the projection on the Y1-Z1 plane. The line interconnecting Pc and Fc forms an angle θo (offset paraboloidal reflector offset angle) with respect to the Z1 axis (FIG. 1(*b*)).

Let the points Pr and Pl be selected as being representative of any points in the right and left halves of the reflector 2. The line interconnecting Mr and Pr is in parallel with the line interconnecting Ml and Pl. When an electromagnetic wave E enters into the reflector 2 from a location whose X1 and Z1 coordinates are negative as shown in FIG. 1(*a*), the line segment MrPr<the line segment MlPl and, therefore, the line segment PrFr>the line segment PlFl, because the line segment MrFr is equal to the line segment MlFl, the line segment MrFr consists of the line segments MrPr and PrFr, and the line segment MlFl consists of the line segments MlPl and PlFl.

When the offset angle θo> the beam deviation angle θb, the line segment PrFr is substantially symmetrical with the line segment PlFl with respect to the direction E' (i.e. the line interconnecting Pc and Fc). Accordingly, as shown in FIGS. 1(*a*) and 1(*b*), the points Fr and Fl on the projection on the X1-Z1 plane are displaced less in the direction along the axis X1, but they are dispersed largely in both the Y1 and Z1 directions and, particularly, in the Y1 direction when projected onto the Y1-Z1 plane.

Similarly, the points Pa and Pu are considered to represent any points on the upper and lower halves of the reflector 2. The line segment PaF minus the line segment PaFa is larger than the segment PuF minus the segment PuFu. Also, as shown in FIGS. 1(*a*) and 1(*b*), the points Pc, Pa and Pu are in the same curved plane, and Fc, Fa and Fu are on the same curved plane, and the points Fa and Fu are on opposite sides of the line segment PcFc in the example shown in FIGS. 1(*a*) and 1(*b*), with the point Fu being more positive in the X1 direction and more negative in the Y1 direction, than Fc.

Accordingly, the points Fa, Fc and Fu are spread along a line which is curved but almost straight, and, accordingly, equiphase points are dispersed in the respective directions X1, Y1 and Z1 on a curved but almost flat plane. The dispersion of the equiphase points is shown in FIGS. 2(*a*) and 2(*b*).

For reducing such dispersion of equiphase points, a correcting function g(x1, y1) is utilized. For example, let it be assumed that the following equation (2) is used as the correcting function g(x1, y1).

$$g(x1,\ y1)=k|x1| \quad (2)$$

where k is greater than 0. Then, the corrected surface function expressing the reflector surface is:

$$z1=[-(x1^2+y1^2)/4(F1+k|x1|)]+F1 \quad (3)$$

where k is a coefficient having a positive value. The reflector surface expressed by the equation (3) is generally shallow dish-shaped as indicated by a dash-and-dot line in FIG. 1(*a*), in which as the value x1 increases the value z1 is smaller than in the conventional paraboloidal reflector. The distance of the right end Pr' of the reflector from the corresponding point on the equiphase surface, and the distance of the left end Pl' of the reflector from the corresponding point on the equiphase surface are both increased. Also, the normals at Pr' and Pl' are closer to the Z1 axis or the normal at Pc than the normals at Pr and Pl. Accordingly, Fr' and Fl' are nearer to Fc', which means that the density of equiphase points around Fc' is higher. Thus, the gain is improved.

By using the following function (4) as the correcting function g(x1, y1), the position of the origin or vertex of the paraboloid can be changed along the X1 axis.

$$g(x1,\ yl)=k|x1|+\beta \quad (4)$$

where |β| is equal to or smaller than D/2, and D is an aperture of the paraboloidal reflector. By properly selecting β, it is possible to further increase the density of equiphase points around Fc', or to deal with electromagnetic waves coming from, for example, two different directions.

Next, the employment of the following expression (5) as the correcting function g(x1, y1) is considered.

$$g(x1, y1)=k(y1—of-D/2) \quad (5)$$

where k is a value smaller than 0. As described above, in the example shown in FIGS. 1(*a*) and 1(*b*), with the line Pc-Fc used as the reference, Fu is more positive than Fc along the X1 axis, and is more negative than Fc along the Y1 axis. Also, Fa is more negative along the X1 axis than Fc and is more positive along the Y1 axis. For the entire reflector, the set of equiphase points corresponding to respective points on the lower half surface of the reflector 2 are more positive along the X1 axis than Fc and more negative along the Y1 axis, while the set of equiphase points corresponding to respective point on the upper half surface of the reflector 2 are more negative along the X1 axis than Fc and more positive along the Y1 axis.

The corrected surface function in which the correcting function g(x1, y1) is incorporated is:

$$z1=[-(x1^2+y1^2)/4(F1+g(x1, y1))]+F1 \quad (6)$$

If g(x1, y1)>0 for a particular (x1, y1), the value of z1 is smaller than $z1=-[(x1^2+y1^2)/4F1]+F1$, and if g(x1, y1)<0 for a particular (x1, y1), the value of z1 is larger than $z1=-[(x1^2+y1^2)/4F1]+F1$.

When the equation (5) is adopted as g(x1, y1), g(x1, y1)>0 when y1<(of+D/2), and g(x1, y1)<0 when y1>(of+D/2). Accordingly, the corrected surface function (6) is a stack of a plurality of paraboloids having successively and smoothly decreasing focal lengths with y1 as it changes from y1= of toward y1=of+D/2. When y1=of+D/2, g(x1, y1)=0, which results in the conventional parabolic function. When y1>of+D/2, g(x1, y1)<0. As y1 increases, the focal length gradually decreases, and the angle formed between E and normals at the respective points becomes larger than in the conventional parabolic function. Therefore, the equiphase points come closer to Fc' than the conventional parabolic function. In other words, the position where the modification of the focal length starts is the point y1=of+D/2.

When y<of+D/2, g(x1, y1)>0. As y1 increases, the focal length gradually decreases and, at the same time, the angle formed between the direction of the wave E and the normal at each point becomes smaller than in the conventional parabolic function. Thus, the equiphase points are closer to Fc' than the ones of the parabolic function. The shape of the reflection surface is indicated by a dash-and-dot line in FIG. 1(*b*), in which the equiphase point corresponding to the upper end Pa' of the reflection surface is indicated by Fa', and the one corresponding to the lower end Pu' is the point Fu'. As is understood, the range over which equiphase points are dispersed is narrow. That is, the density of equiphase points increases, resulting in increase of the gain. FIGS. 2(*c*) and 2(*d*) illustrate how equiphase points are dispersed when k=−0.02 in the expression (5). Comparing FIGS. 2(*a*) and 2(*b*) with FIGS. 2(*c*) and 2(*d*), respectively, it will be understood that the employment of the expression (5) for the correcting function g(x1, y1) can provide more improvement on the convergence of equiphase points.

Next, the use of the following expression (7) as the correcting function g(x1, y1) is considered.

$$g(x1, y1)=k(y1+\alpha) \quad (7)$$

where |α| is equal to or smaller than of+D. If α=—of−D/2, the expression (7) is the same as the expression (5). Accordingly, by selecting the value for a from the range of |α| is equal to or smaller than of +D, it is possible to place the point where the focal length starts to be corrected at any location on the reflection surface. The dispersion of the equiphase points can be further reduced by selecting a proper value for α. Then, the density of the equiphase points can be further improved, and electromagnetic waves coming from, for example, two different directions can be handled by the reflector.

The combination of the two correcting functions (2) and (5), i.e. the following expression (8), may be used as the correcting function g(x1, y1).

$$g(x1, y1)=k(y1\text{-}of-D/2+|x|) \quad (8)$$

In this case, by selecting a proper value for k, all of Fr, Fl, Fa and Fu can be made to locate in the vicinity of Fc.

Figure 3:
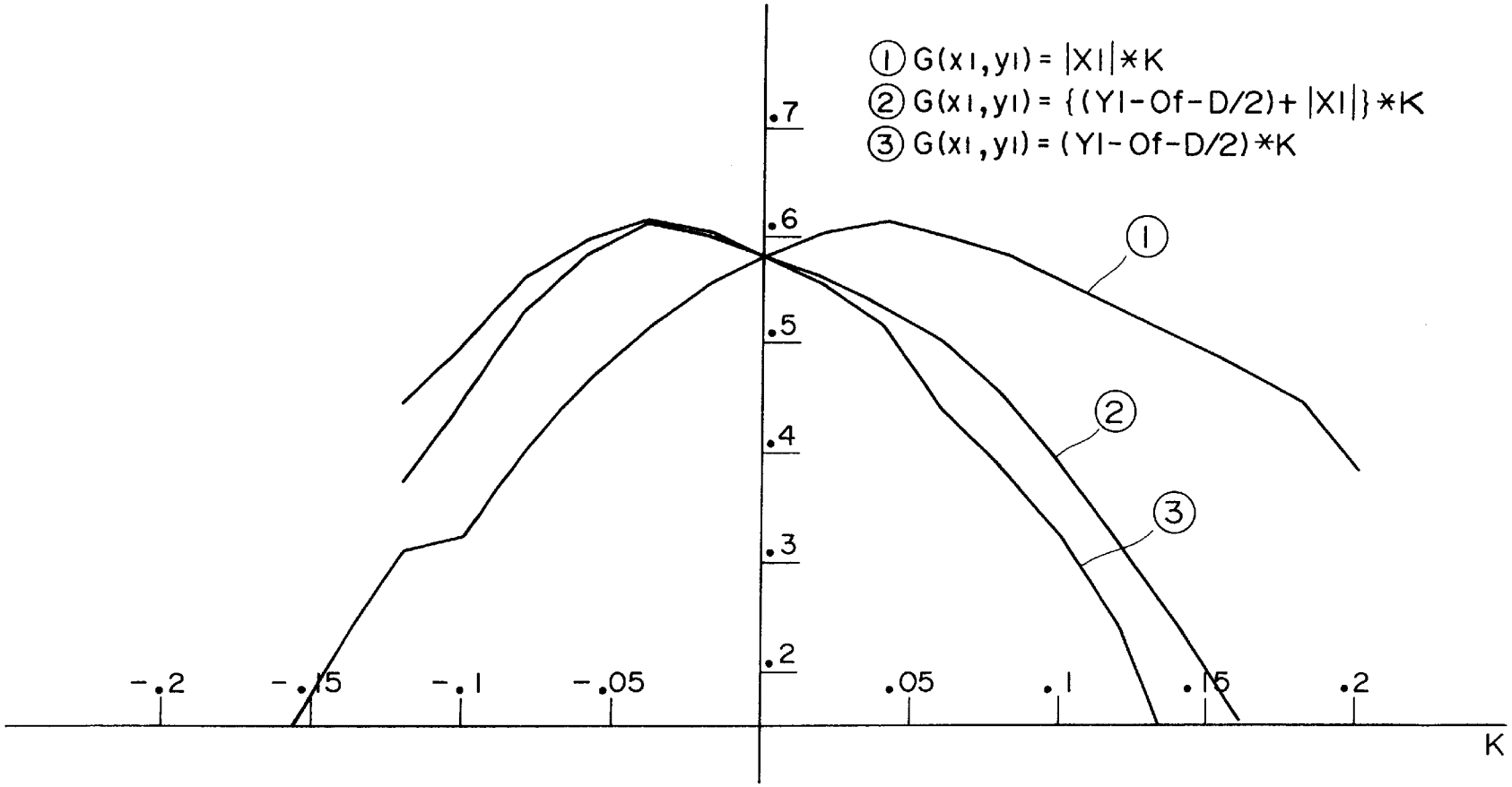
FIG. 3 illustrates how convergence of equiphase points change when a coefficient k is changed in the reflector according to the basic corrected surface function of the present invention.

FIG. 3 shows how the equiphase points can converge when the correcting functions (2), (5) and (8) are employed, and θb=10 degrees, with k varied from a value near −0.2 to a value near +0.2. In FIG. 3, the vertical axis is for the density of equiphase points converted into the antenna efficiency. The antenna efficiency is unity when an electromagnetic wave enters into the conventional paraboloidal antenna from the front. By selecting a value from a range of from about −0.2 to about +0.2 for k, good results was obtained. In particular, when θb=10°, the peak is within a range of from about −0.1 to about +0.1 of k. More specifically, the peaks when the functions (5) and (8) are employed are in the vicinity of −0.05, and the peak when the function (2) is employed is in the vicinity of +0.05. These peak densities are about 0.64.

Figure 4:
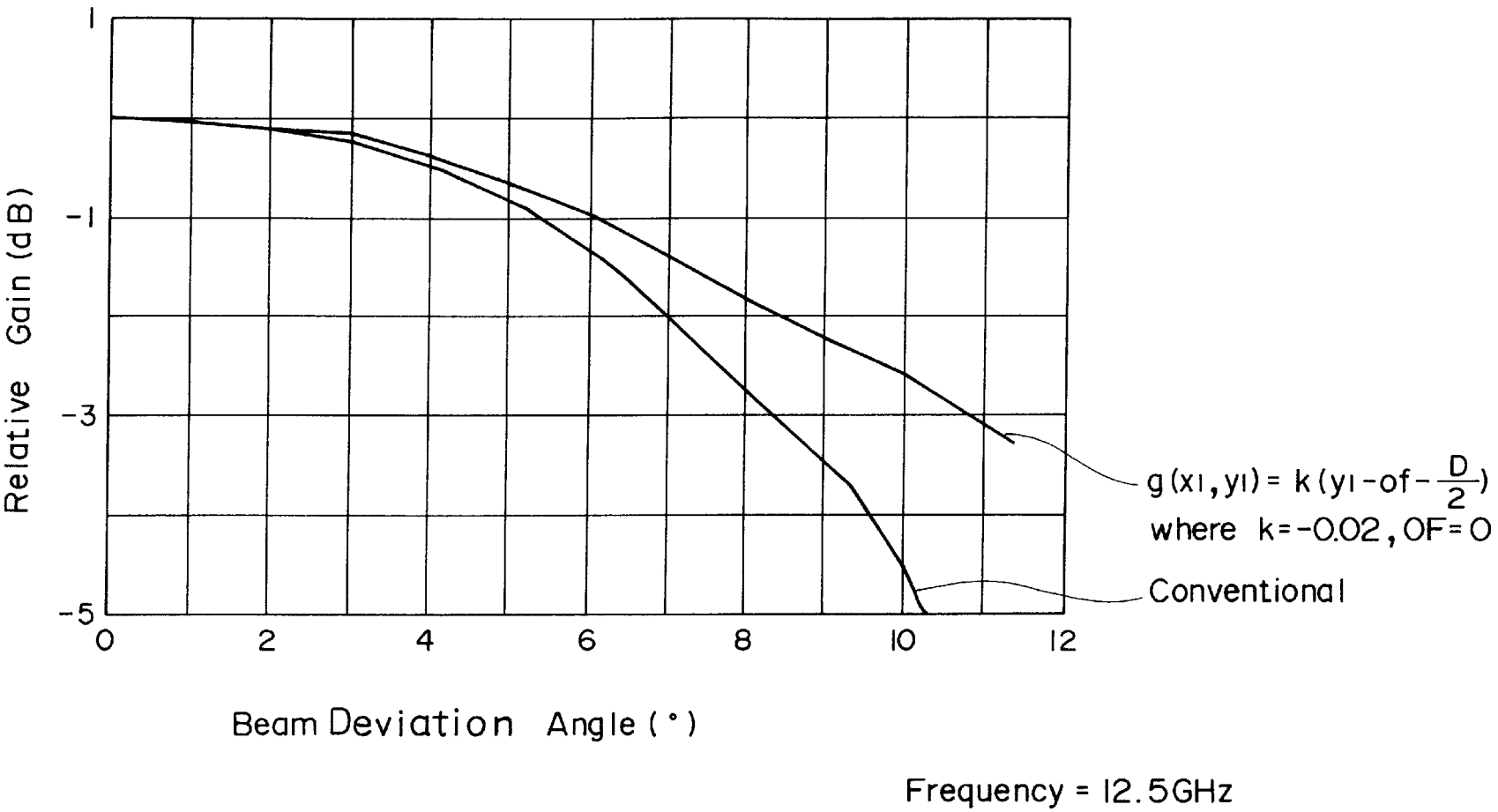
FIG. 4 shows a relationship between a beam deviation angle and a relative gain in the reflector according to the basic corrected surface function of the present invention.

FIG. 4 shows how the relative gain of the reflector expressed by the corrected surface function employing the correcting function (5), in which D=755 mm, F=453 mm, of =0 and k=−0.02, and the relative gain of a conventional paraboloidal reflector having the same dimensions change, with the beam deviation angle θb changing from 0°. It is seen from FIG. 4, the present invention can provide a wider effective deviation angle than the conventional paraboloidal reflector.

Generalizing all of the above-described correcting functions results in the following correcting function (9).

$$g(x1, y1)=k1(y1+\alpha)+k2(|x1|+\beta) \quad (9)$$

where |α| is equal to or smaller than (of+D), and |β| is equal to or smaller than D/2. The coefficients k1 and k2 may have any value, but they may preferably have a value within a range of from −0.2 to +0.2, as discussed with reference to FIG. 3. In FIG. 3, θb is 10°,but the beam deviation angle θb of any different value may be handled by selecting proper values for α, k1 and k2 and selecting one or more appropriate correcting functions.

Figure 5:
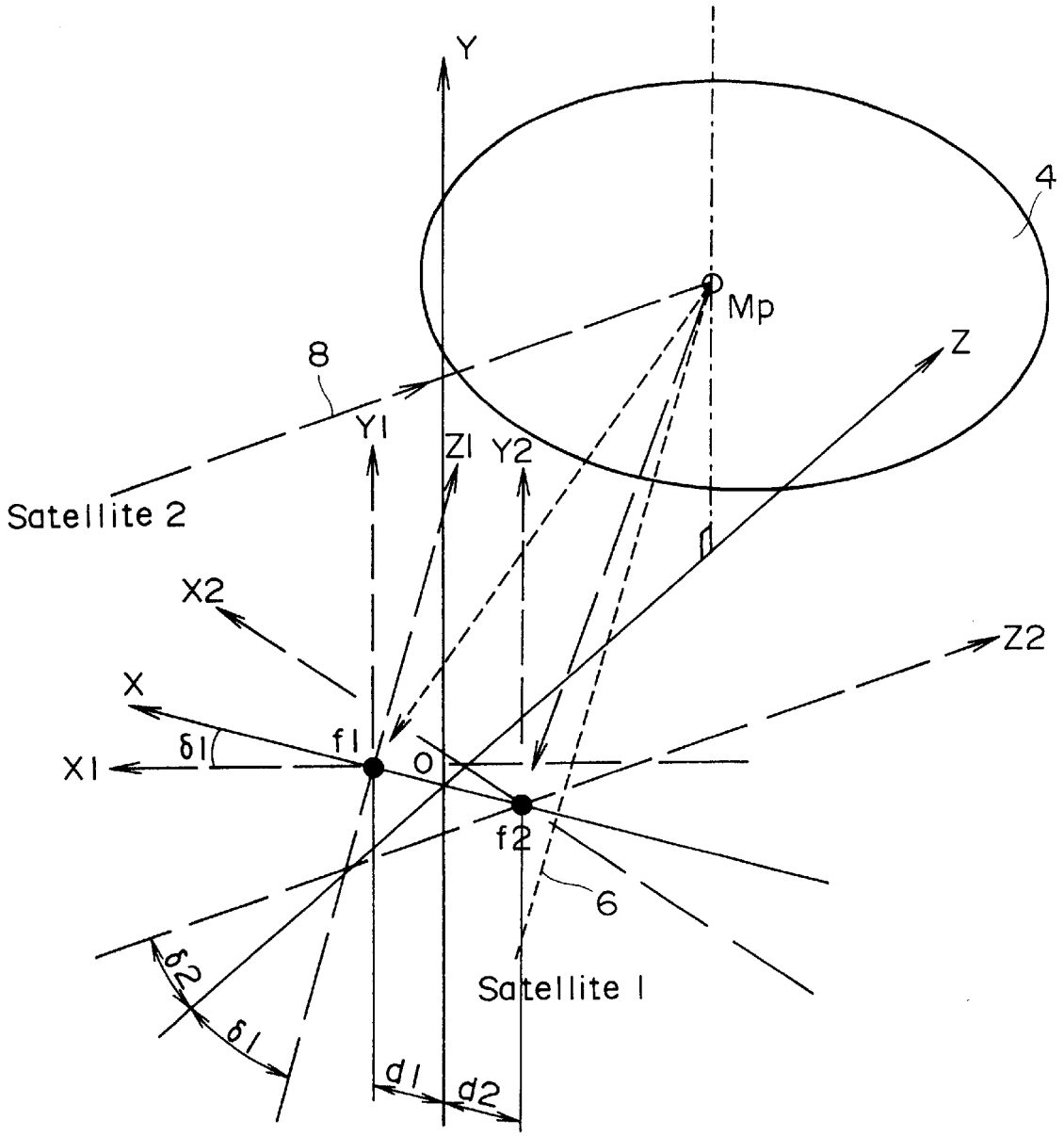
FIG. 5 is perspective view of a multibeam antenna reflector according to one embodiment of the present invention.
Figure 6:
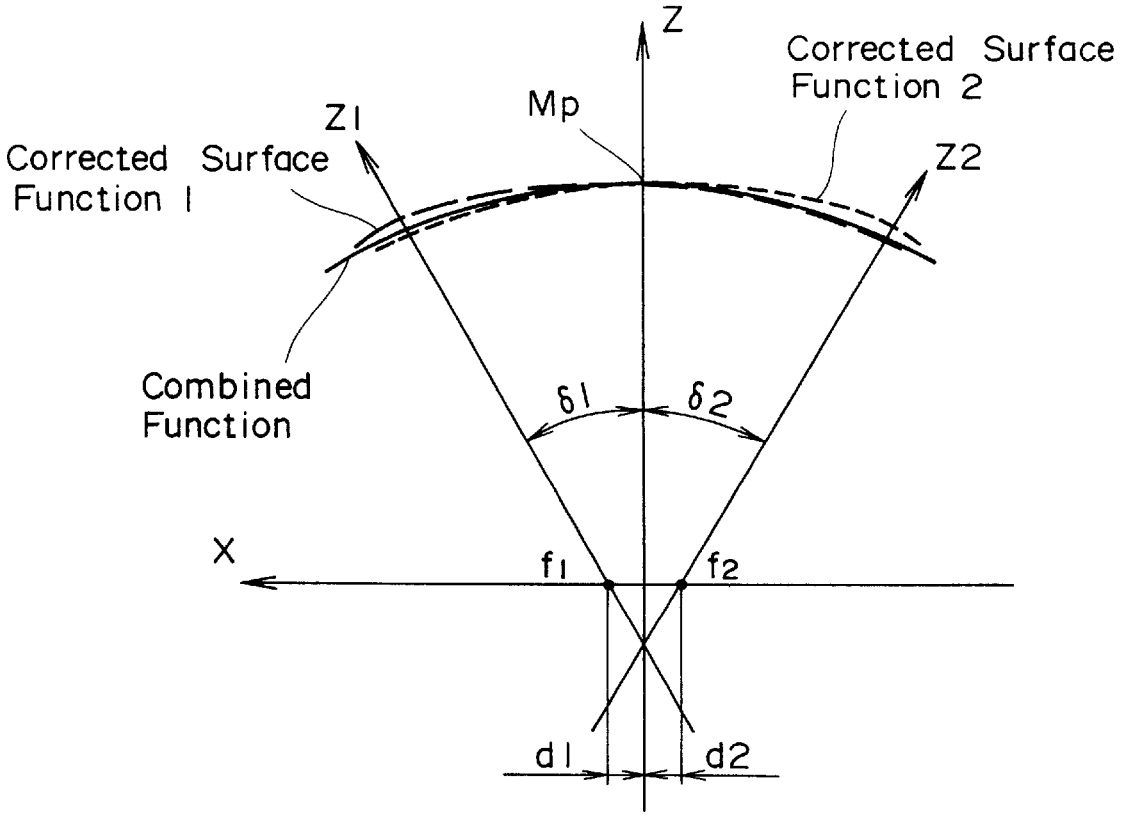
FIG. 6 is a plan view of the multibeam antenna reflector of FIG. 5.

Two reflectors prepared in accordance with the above-described corrected surface functions are combined or merged together to form a reflector 4 shown in FIGS. 5 and 6. Referring to FIG. 5, the corrected surface function 1 for a reflector mainly reflecting an electromagnetic wave 6 from a satellite 1 may be expressed by the following equation (10), for example, in a right handed coordinate system which has its origin at the focal point f1 of the reflector, the Z1 axis extending in the positive direction through the origin toward the reflector expressed by the corrected surface function 1, the horizontal X1 axis, and the vertical Y1 axis. In the expression (10), g(x1, y1) =k(y1−D/2−of), and F1 represents the focal length.

$$z1=[-(x1^2+y1^2)/4(F1+g(x1, y1))]+F1 \quad (10)$$

Similarly, the corrected surface function 2 for a reflector mainly reflecting an electromagnetic wave 8 from a satellite 2 may be expressed by the following equation (11), for example, in a right handed coordinate system which has its origin at the focal point f2 of the reflector, the Z2 axis extending in the positive direction through the origin toward the reflector expressed by the corrected surface function 2, the horizontal X2 axis, and the vertical Y2 axis. In the expression (11), g(x2, y2)=k(y2−D/2—of), and F2 represents the focal length.

$$z2=[-(x2^2+y2^2)/4(F2+g(x2, y2))]+F2 \quad (11)$$

These two coordinate systems are arranged in a coordinate system including the X, Y and Z axes as shown in FIG. 6. In the coordinate system shown in FIG. 6, the two focal points f1 and f2 are spaced by a distance d1+d2 from each other so that the angle between the waves from the satellites 1 and 2 is equally divided into two parts, namely, δ1 and δ2, that the coordinate values at the combination center Mp of the two corrected surface functions 1 and 2 are the same, and that the normal to the combination center Mp of the two corrected surface functions 1 and 2 are aligned. The X axis extends in the positive direction through the focal points f2 and f1 in the name order with the origin O of the coordinate system being located at the midpoint between the points f1 and f2. The Z axis extends in the positive direction generally coincident with the directions of propagation of the waves from the satellites 1 and 2. The Z axis extends orthogonal to the X axis. It extends through the origin O and lies in the plane in which the lines interconnecting the combination center Mp and the satellites 1 and 2, respectively, lie. Thus, the Z axis bisects the angle between the electromagnetic waves from the satellites 1 and 2 into the angles δ1 and δ1. In other words, the angles δ1 and δ2 are beam deviation angles. The Y axis is such that the coordinate system with the X, Y and Z axes is a right handed coordinate system.

Considering the corrected surface functions in the coordinate system with the X, Y and Z axes, the corrected surface function 1 is the function expressed by the equation (10) as rotated by δ1 from the positive direction of the Z axis toward the positive direction of the X axis and translated by d1 in the positive direction along the X axis in the X-Z plane, while the corrected surface function 2 is the function expressed by the equation (11) as rotated by δ2 from the positive direction of the Z axis toward the negative direction of the X axis and translated by d2 in the negative direction along the X axis, in the X-Z plane.

The corrected surface function 1 is weighted by W1, and the corrected surface function 2 is weighted by W2. Then, the weighted, corrected surface functions 1 and 2 are averaged to form a combined function, which defines a reflection surface. The weight WI is expressed by the following equation (12). The weight W2 is 1−W1. The weights W1 and W2 are positive values.

$$W1=||x-D/2|-D|/D \quad (12)$$

Thus, when x=0, i.e. in the Y-Z plane, W1 and W2 are equal to 0.5. When x is D/2, W1=1 and W2=0. When x=−D/2, W1=0 and W2=1. Then, the combined function has a value intermediate between the corrected surface functions 1 and 2 when x=0,has a value as expressed by the corrected surface function 1 when x=D/2, and has a value as expressed by the corrected surface function 2 when x=−D/2.

Figure 7:
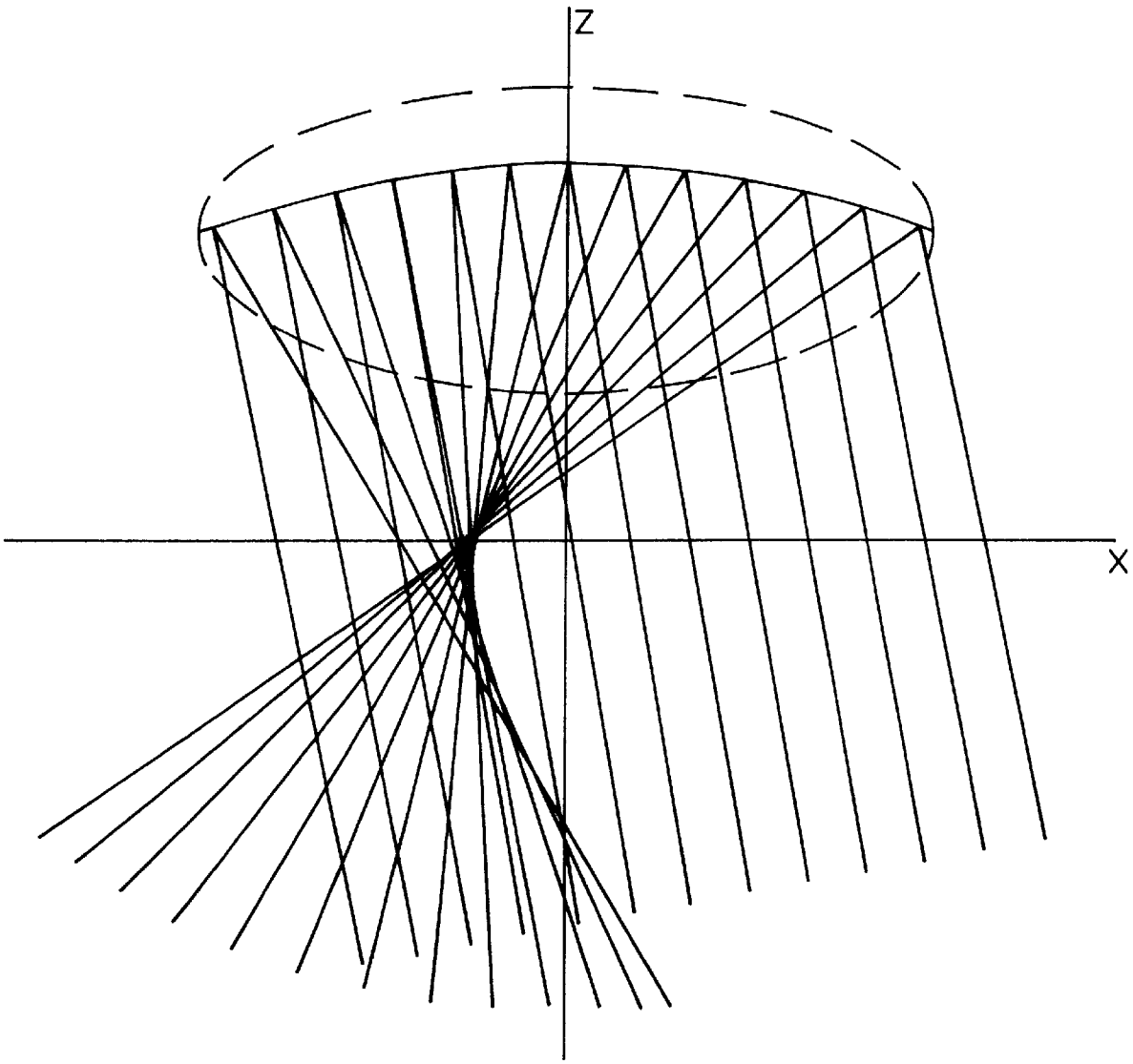
FIG. 7 shows a simulation of aberration generated in the multibeam antenna reflector of FIG. 5 when the beam deviation angle is 10 degrees.
Figure 8:
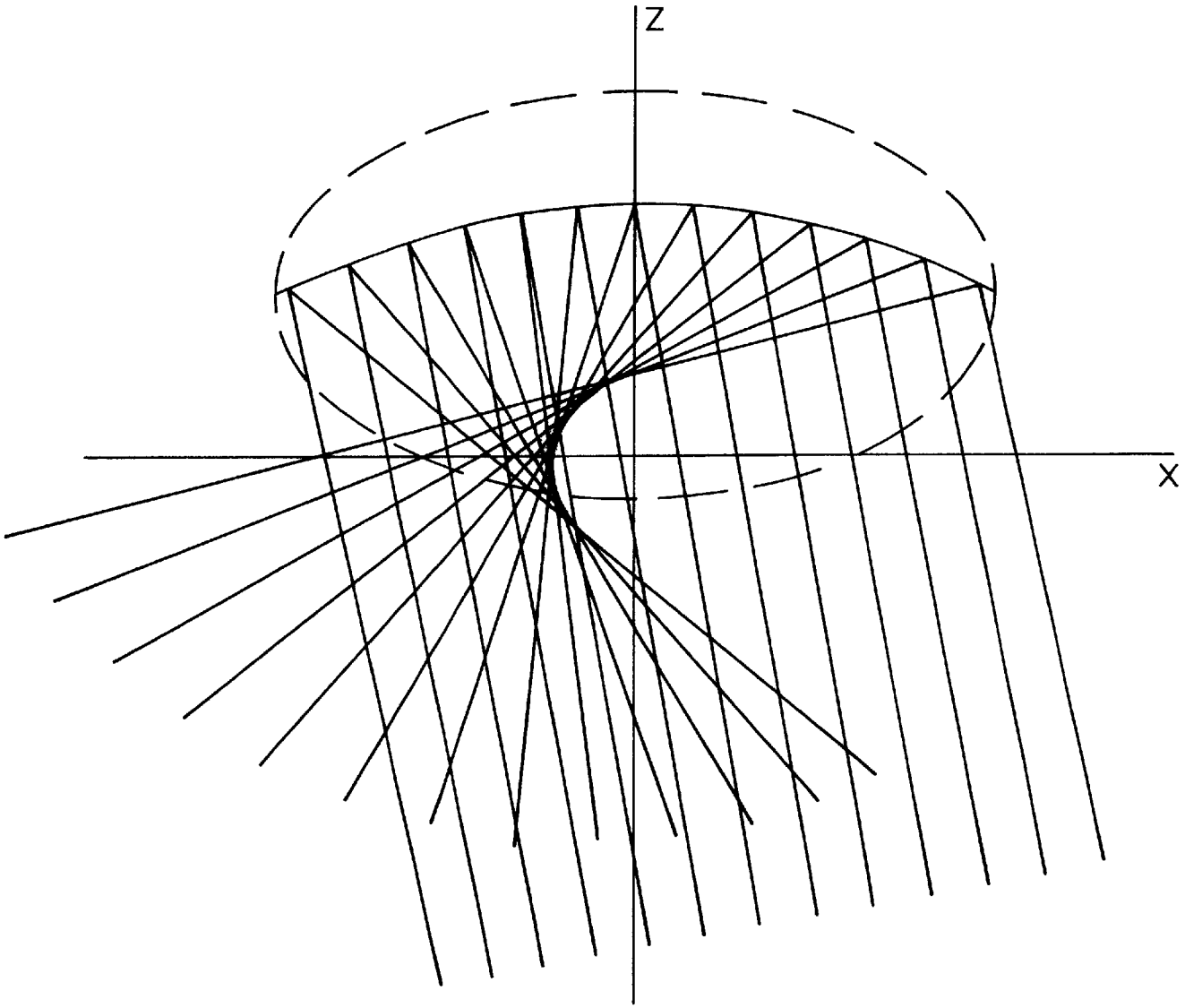
FIG. 8 shows a simulation of aberration generated in an ordinary paraboloidal reflector when the beam deviation angle is 10 degrees.

FIG. 7 shows the result of simulation conducted for the generation of aberration at the beam deviation angle of 10 degrees of a reflector formed according to combined corrected surface functions, in which D=457.2 mm, the focal lengths F1=F2=274.32 mm, g(x1, y1)=−0.01(y1−D/2), g(x2, y2)=−0.01 (y2−D/2), δ1=−10°, δ2=10°, W1=||x−D/2|−D|/D, and of=0. For the purpose of comparison, FIG. 8 shows the result of simulation on aberration at the beam deviation angle of 10 degrees of an offset paraboloidal reflector having a focal length of 230 mm, an aperture of 457.2 mm and an amount of offset of 30 mm. The comparison of FIG. 7 with FIG. 8 evidences the fact that the reflector shown in FIG. 7 has smaller aberration than the reflector of FIG. 8. It is also known that the antenna gain is 33.5 dB in FIG. 7, whereas the antenna gain of the reflector of FIG. 8 is 32.9 dB, which means that the reflector of FIG. 7 is improved in antenna gain by about 0.6 dB relative to the reflector of FIG. 8.

Figure 9:
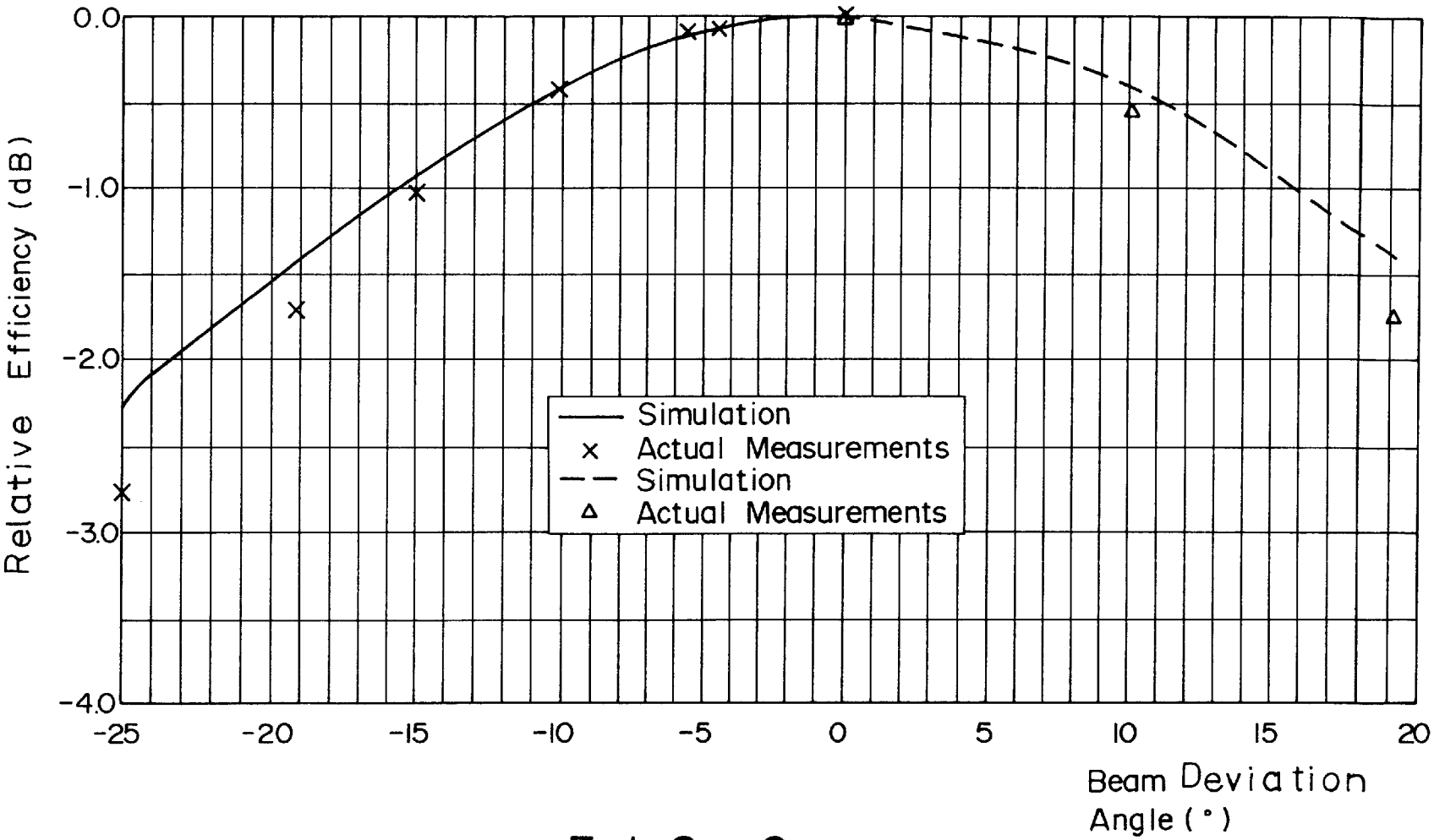
FIG. 9 shows a relationship between a beam deviation angle and a relative efficiency as simulated and as actually measured for the multibeam antenna reflector of FIG. 5.

The relative efficiency changing with the beam deviation angle of the reflector expressed by the combined corrected surface functions was simulated. Also, a reflector having the above-described combined, corrected surface functions, having a horizontal diameter of 472.6 mm and a vertical diameter of 445.3 mm was experimentally made, and the relative efficiency changing with the beam deviation angle was actually measured. The results of the simulation and the actual measurement are shown in FIG. 9. The solid line curve is a curve resulting from the simulation for a primary radiator positioned at the focal point f1 which is adapted to receive waves coming at a beam deviation angle of from −25° to 0°, and the x'es are the actual measurements for the radiator positioned at the point f1. The broken line curve and triangles are for a primary radiator positioned at the focal point f2 which is adapted to receive waves coming at a beam deviation angle of from 0° to 20°. The actually measured values and the simulated values are generally coincident with each other within the deviation angle range of about ±15°.

Figure 10:
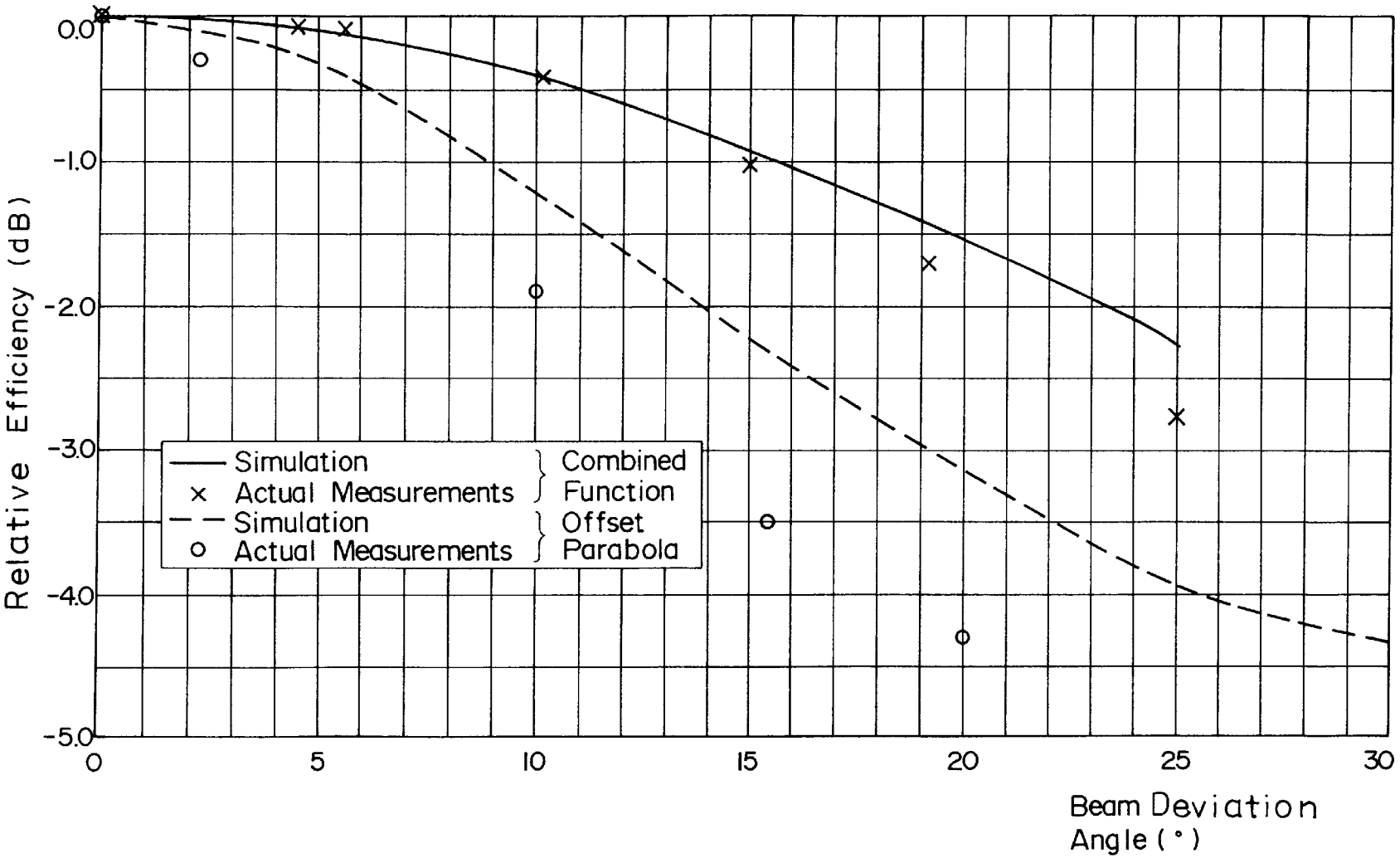
FIG. 10 shows a relationship between the beam deviation angle and a relative efficiency as actually measured and as simulated for each of the multibeam antenna reflector of FIG. 5 and the conventional offset paraboloidal reflector.

The simulated and actually measured values shown in FIG. 9 are also shown in FIG. 10 together with the simulated and actually measured values of relative efficiency changing with the deviation angle of the above-mentioned offset paraboloidal reflector.

It is seen from FIG. 10 that both the simulated and actually measured reductions of efficiency are less in the reflector defined by the combined corrected surface functions than in the conventional offset paraboloidal reflector over a wide range of beam deviation angles. The combined corrected surface function reflector with a beam width of about 3.7° has reduction of efficiency of only about 2.0 dB at a location remote by six times the beam width. In other words, the combined corrected surface function reflector can be used with a beam displaced up to six times the beam width. In contrast, the reduction of efficiency of about 2.0 dB results when the beam deviation angle is about 14° in the conventional offset paraboloidal reflector. In other words, the conventional offset paraboloidal reflector can efficiently receive a wave within a range of only about 3.5 times the beam width.

It is because the corrected surface functions 1 and 2 are combined that a larger beam deviation angle can be obtained. Because of a larger beam deviation angle, the multibeam antenna reflector according to the present invention can receive electromagnetic waves coming into it from various directions.

Figure 11:
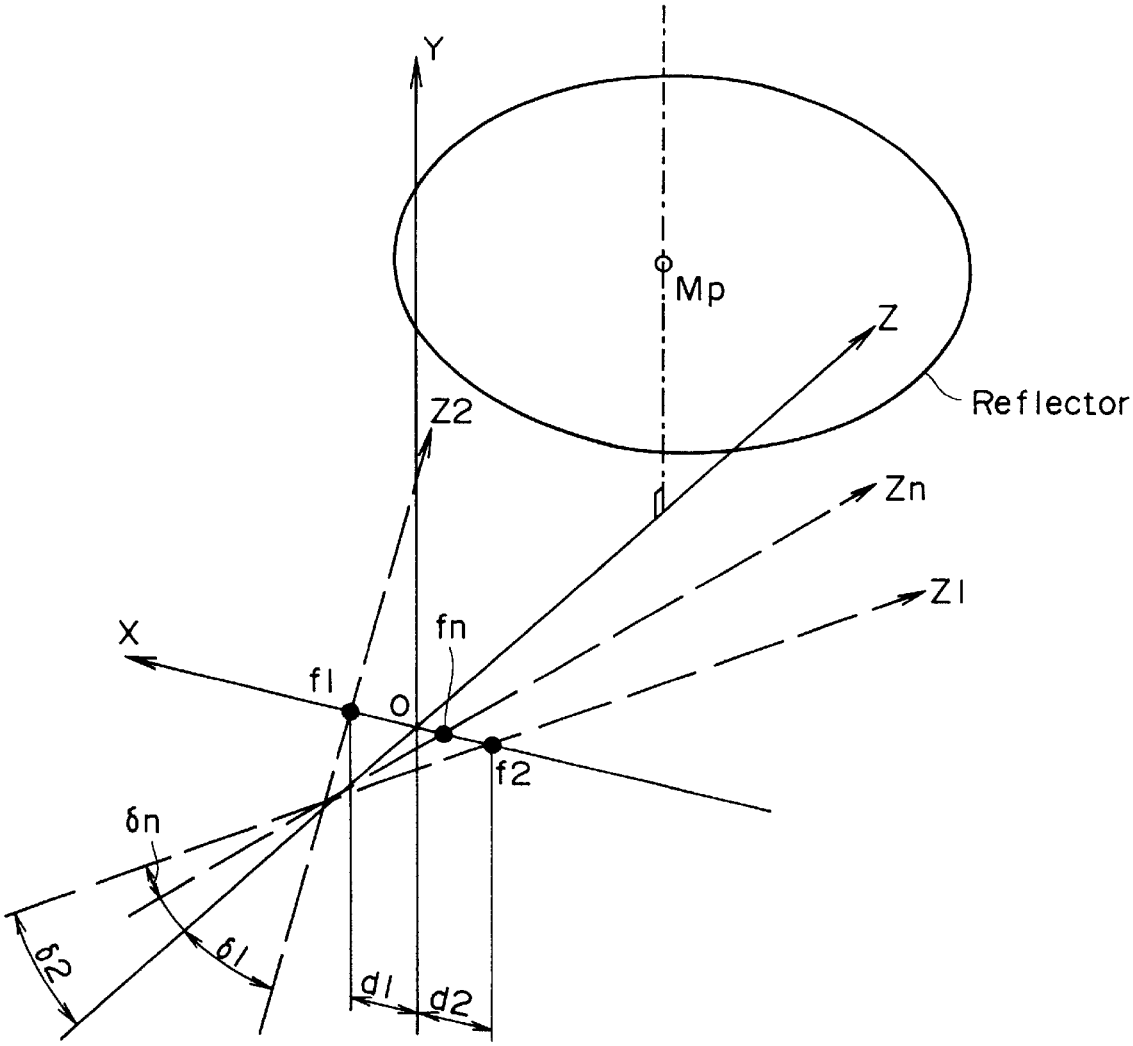
FIG. 11 is a perspective view of a multibeam antenna reflector according to another embodiment of the present invention.

The present invention has been described by means of a multibeam antenna reflector formed by combining the two corrected surface functions 1 and 2. However, (m−2) additional corrected surface functions or parabolic functions may be combined with the functions 1 and 2, where the number m is a positive integer greater than 3. For example, FIG. 11 shows focal points f1, f2 and fn of the first, second and n-th corrected surface functions 1, 2 and n out of the m functions combined. In this case, $\delta 1=\delta 2$, and the beam deviation angle $\delta n$ is smaller than $\delta 1$ or $\delta 2$. The parabolic function or n-th corrected surface function can be expressed, with respect to a coordinate system defined by an Xn axis extending horizontally with respect to the reflector surface, a vertically extending Yn axis and a Zn axis extending toward the reflector surface, by $zn=[-(xn^2+yn^2)/4Fn]+Fn$ or $zn=[-(xn^2+yn^2)/4(Fn+g(xn, yn))+Fn$, where g(xn, yn) is expressed as $k1(yn+\alpha)+k2(|xn|+\beta)$, as previously described. In the last expression, $\alpha$ is not smaller than −(of +D) and not greater than (of+D), $\beta$ is not smaller than −D/2 and not greater than D/2, of is the offset amount of the reflector which is not smaller than 0, D is the diameter of a circle resulting from projecting a desired area of the n-th function onto the Xn-Yn plane, Fn is the focal length of the n-th corrected surface function or parabolic function, and k1 and k2 are coefficients.

The weights W1–Wn used in weighted-averaging these functions are all positive values. The weights W1 and W2 are expressed by the following expressions (13) and (14), with the sum of W3 through Wm being smaller than unity.

$$W1=\left(1-\sum_{t=3}^{n}W_i\right)\frac{\left|\left|x-\frac{D}{2}\right|-D\right|}{D} \tag{13}$$

$$W2=1-W1-\sum_{t=3}^{n}W_i \tag{14}$$

What is claimed is:

1. A multibeam antenna reflector having a reflection surface expressed by a combination of at least first and second corrected surface functions, wherein:

in a coordinate system defined by an X1 axis horizontally extending across an aperture of said reflector, a Y1 axis vertically extending across said aperture, and a Z1 axis extending perpendicularly to said X1 and Y1 axes, said first corrected surface function is expressed by $$z1=[-(x1^2+y1^2)/4(F1+g(x1, y1))]+F1$$

where g(x1, y1) is expressed by $k1(y1+\alpha)+k2(|x1|+\beta)$, (being a value not smaller than −(of +D) and not greater than (of +D), $\beta$ being a value not smaller than −D/2 and not greater than D/2, of being an offset amount of said reflector which is not smaller than 0, D being a diameter of a circle resulting from projecting a desired area of said first corrected surface function onto the X1-Y1 plane, F1 being a focal length of said first corrected surface finction, k1 and k2 being coefficients;

in a coordinate system defined by an X2 axis horizontally extending across an aperture of said reflector, a Y2 axis vertically extending across said aperture, and a Z2 axis extending perpendicularly to said X2 and Y2 axes, said second corrected surface function is expressed by $$z2-[-(x2^2+y2^2)/4(F2+g(x2, y2))]+F2$$

where g(x2, y2) is expressed by $k1(y2+\alpha)+k2(|x2|+\beta)$, $\alpha$ being a value not smaller than −(of +D) and not greater than (of+D), $\beta$ being a value not smaller than −D/2 and not greater than D/2, of being an offset amount of said reflector which is not smaller than 0, D being a diameter of a circle resulting from projecting a desired area of said second corrected surface function onto the X2-Y2 plane, F2 being a focal length of said second corrected surface function, k1 and k2 being coefficients;

said reflection surface ties in a combined area provided by weighting and averaging said first and second corrected surface functions with said Z1 and Z2 axes being disposed in parallel with respective directions in which at least two electromagnetic waves propagate, and focal points of first and second corrected surface functions are determined such that coordinate values of said first and second corrected surface functions at the center of said combined area are the same and normals of said first and second corrected surface functions at the center of said combined area are aligned.

2. The multibeam antenna reflector according to claim 1 wherein k2=0, k1<0, and $\alpha$=−(of+D/2).

3. The multibeam antenna reflector according to claim 1 wherein k1=0, k2>0, and $\beta$=0.

4. The multibeam antenna reflector according to claim 1 wherein k1=0.

5. The multibeam antenna reflector according to claim 1 wherein k1=k2, $\alpha$=−(of+D/2), and $\beta$=0.

6. The multibeam antenna reflector according to claim 1 wherein k1 and k2 are not smaller than −0.2 and not greater than 0.2.

7. The multibeam antenna reflector according to claim 1 wherein additional m-2 surface functions are combined with said first and second corrected surface functions by being weighted and averaged with said first and second functions, where m is a positive integer equal to or greater than 3; and an n-th one of the m functions is a parabolic function or a corrected surface function in a coordinate system defined by a horizontal axis Xn, a vertical axis Yn and an axis Zn perpendicular to both the Xn and Yn axes, where n is a positive integer equal to or greater than 3 and equal to or smaller than m, with the axis Zn disposed along the direction from which an n-th electromagnetic wave comes.

* * * * *